US006810826B1

(12) United States Patent
Bellis, Jr.

(10) Patent No.: US 6,810,826 B1
(45) Date of Patent: Nov. 2, 2004

(54) ANCHORING SYSTEM FOR BOAT

(76) Inventor: William B. Bellis, Jr., 1401 Schuff La., Louisville, KY (US) 40205

( * ) Notice: Subject to any disclaimer, the term of this patent is extended or adjusted under 35 U.S.C. 154(b) by 0 days.

(21) Appl. No.: 10/702,762

(22) Filed: Nov. 6, 2003

Related U.S. Application Data

(60) Provisional application No. 60/425,889, filed on Nov. 13, 2002.

(51) Int. Cl.[7] ..... B63B 21/24
(52) U.S. Cl. ..... 114/293; 114/102.19
(58) Field of Search ..... 114/102.19, 293, 114/294, 144 B

(56) References Cited

U.S. PATENT DOCUMENTS 3,461,828 A * 8/1969 Bielstein ..... 114/265
3,935,830 A 2/1976 Cox
3,991,699 A 11/1976 Bass
RE29,373 E * 8/1977 Boschen, Jr. ..... 114/293
4,122,794 A 10/1978 Rossini
4,480,573 A 11/1984 Barbour
4,864,955 A 9/1989 Bruce
5,062,375 A 11/1991 Makielski
6,009,826 A 1/2000 Nole
6,092,484 A 7/2000 Babin et al.

* cited by examiner

*Primary Examiner*—Ed Swinehart
(74) *Attorney, Agent, or Firm*—Camoriano and Associates; Theresa Fritz Camoriano

(57) ABSTRACT

A device is disclosed for an anchoring system for a boat which permits the user to deploy the anchor from the side or rear of the boat, and for the anchoring point on which the anchor rope acts to travel from the side or rear of the boat to the front of the boat.

10 Claims, 11 Drawing Sheets

ANCHORING SYSTEM FOR BOAT

This application claims priority from U.S. Provisional Application Ser. No. 60/425,889, filed Nov. 13, 2002, which is hereby incorporated herein by reference.

BACKGROUND OF THE INVENTION

The present invention relates to boats, and, in particular, to a system for deploying an anchor on a boat. It is primarily intended to be used on performance boats, small cabin cruisers, and other boats in which it is difficult to reach the front or bow of the boat from inside the boat, and in which there is not a windlass anchor. It is known that the anchor should be deployed from the bow of the boat. However, in these types of boats, since it is very difficult or impossible to reach the bow of the boat to deploy the anchor, it usually is deployed from the side or rear of the boat, which means that the boat is not positioned properly relative to the anchor.

SUMMARY OF THE INVENTION

The present invention provides an anchoring system which allows a person to deploy the anchor from the side or rear of the boat and for the anchoring point on which the anchor rope acts to travel from the side or rear of the boat to the front, so that, when the anchor is fully deployed and the rope is stretched tight from the anchor to the boat, the anchoring point of the rope is at the front or bow of the boat.

DESCRIPTION OF THE PREFERRED EMBODIMENTS

Figure 1:
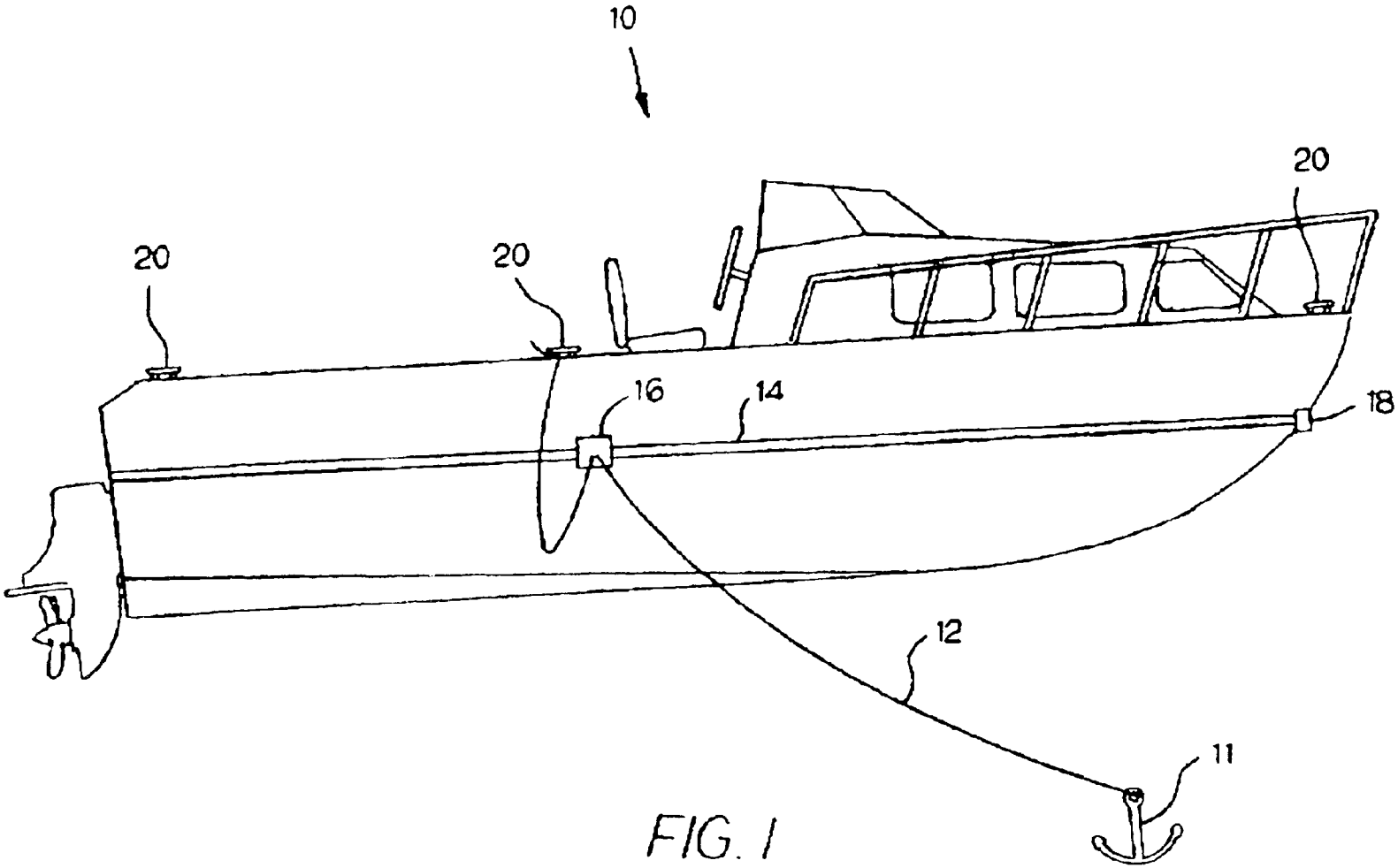
FIG. 1 is a side view of a boat with an anchoring system made in accordance with the present invention, showing the anchoring point at its initial position as the anchor is being deployed.

FIG. 1 shows a boat 10, which includes an anchoring system made in accordance with the present invention. The anchoring system includes an anchor rope 12, which extends from the anchor 11 to the boat 10, a track 14, which extends around the perimeter of the hull of the boat 10, a track follower 16, which provides an anchoring point for the rope 12 and which mates with the track 14 for movement along the track 14, and a stop 18, which cooperates with the track follower 16 to releasably secure the track follower 16 at the bow of the boat. The boat 10 also includes a plurality of tie-down points 20 at various positions around the top of the hull. The word "rope", as used herein, means anything that functions as a rope, including rope, wire, cable, and other similar products.

In order to deploy the anchor 11, the person secures one end of the rope 12 to a tie-down point 20 on the boat 10 and the other end of the rope 12 to the anchor 11. An intermediate point of the rope 12 is secured to the track follower 16. (The rope 12 could be made of separate ropes, for example, one extending from the tie-down point 20 to the track follower 16, and another extending from the track follower 16 to the anchor 11.) The person mounts the track follower 16 onto the track 14 for travel along the track 14, positions the track follower 16 adjacent the side of the boat 10, and then deploys the anchor 11 by dropping it over the side of the boat 10. The boat 10 then moves rearwardly relative to the anchor 11, carried by current or wind, and the portion of the rope 12 between the anchor 11 and the track follower 16 tightens, as shown in FIG. 1.

Figure 2:
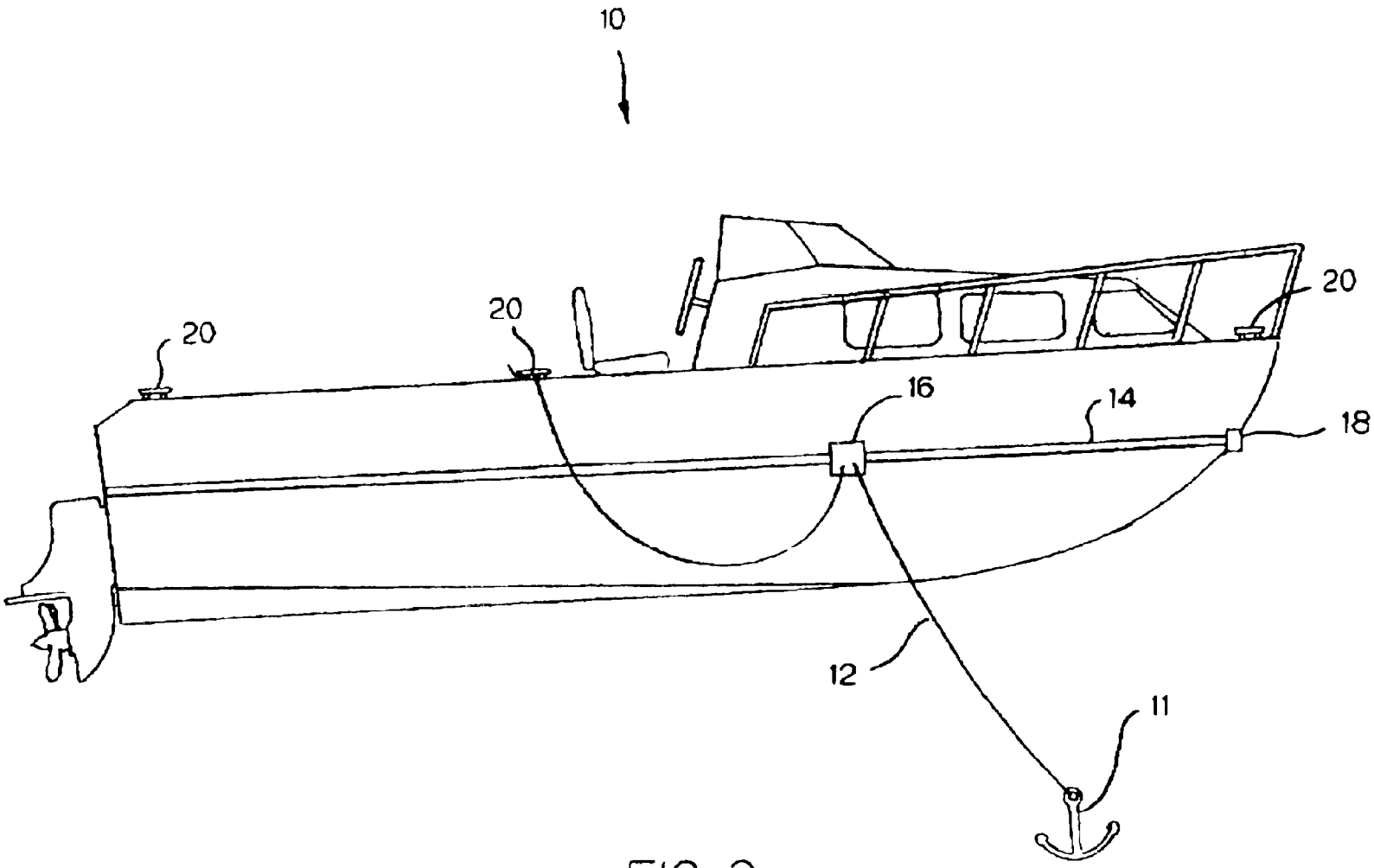
FIG. 2 is the same view as FIG. 1, but with the anchoring point beginning to travel toward the bow of the boat.

As the boat 10 continues to move rearwardly relative to the anchor 11, the track follower 16 travels forward along the track 14 toward the bow of the boat 10, as shown in FIG. 2.

Figure 3:
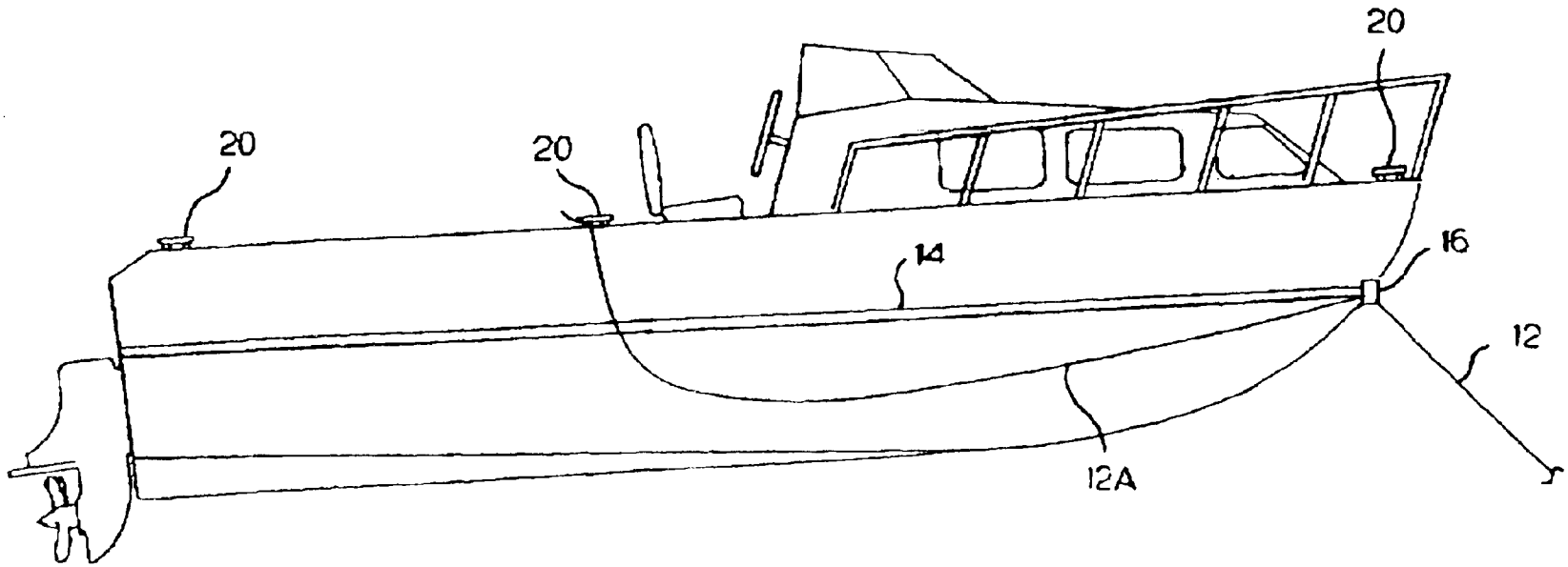
FIG. 3 is the same view as FIG. 2, but with the anchoring point at the bow of the boat.

The boat continues to move rearwardly relative to the anchor 11, until the track follower 16 reaches the bow of the boat 10, as shown in FIG. 3. At this point, the track follower 16 releasably secures itself to the stop 18, which is now hidden by the track follower 16. (It is not necessary to have a stop 18 at the bow of the boat, as the anchoring track follower 16 will tend to remain at the bow of the boat even without a stop.)

With the track follower 16 at the bow of the boat, as shown in FIG. 3, the boat 10 properly extends rearwardly from the anchor, and the anchoring point (the point at which the anchor rope acts on the boat) is at the bow (the front portion) of the boat (at the anchoring track follower 16), which is the desired position for anchoring a boat.

Figure 4:
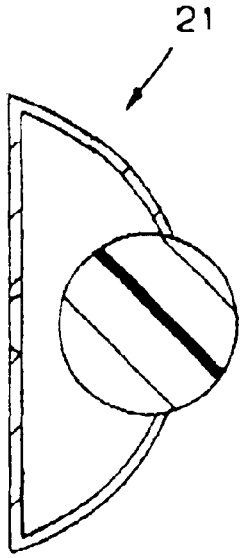
PRIOR ART FIG. 4
FIG. 4 is a section view through a standard rub rail for a boat.
Figure 6:
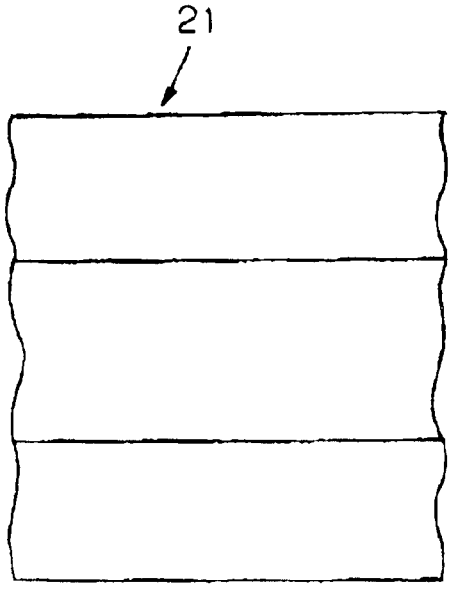
PRIOR ART FIG. 6
FIG. 6 is a front view of the rub rail of FIG. 4.
Figure 5:
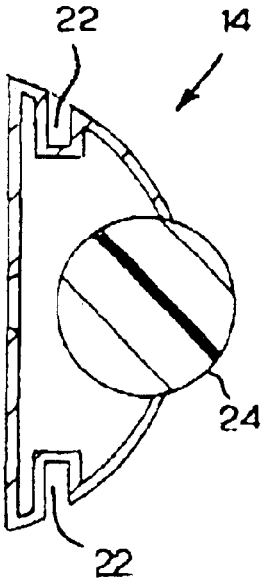
FIG. 5 is a section view through a rub rail for use with the present invention.
Figure 7:
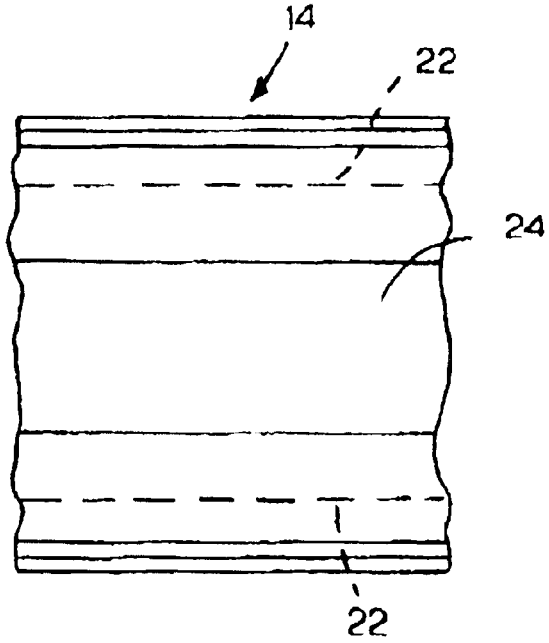
FIG. 7 is a front view of the rub rail of FIG. 5.

The parts of the anchoring system will now be described in more detail. FIGS. 4 and 6 show a typical prior art rub rail 21 that is usually used on boats. FIGS. 5 and 7 show a rub rail that has been modified to serve as a track 14. The track 14 may replace the prior art rub rail 21, or it may be mounted on the boat parallel to the rub rail 21. This track 14 defines upper and lower grooves 22 for receiving the track follower 16, which is shown in more detail in FIG. 10. This particular track 14 also includes an elongated cushion 24, which enables it to function as a rub rail and protects the track 14 and the boat if the boat bumps into the dock or some other object. If the track 14 is not intended to serve the function of a rub rail, it would not necessarily include a cushion 24. The track 14 may be secured to the hull of the boat by various known means, such as by screwing it into the hull or by adhering it to the hull.

Figure 8:
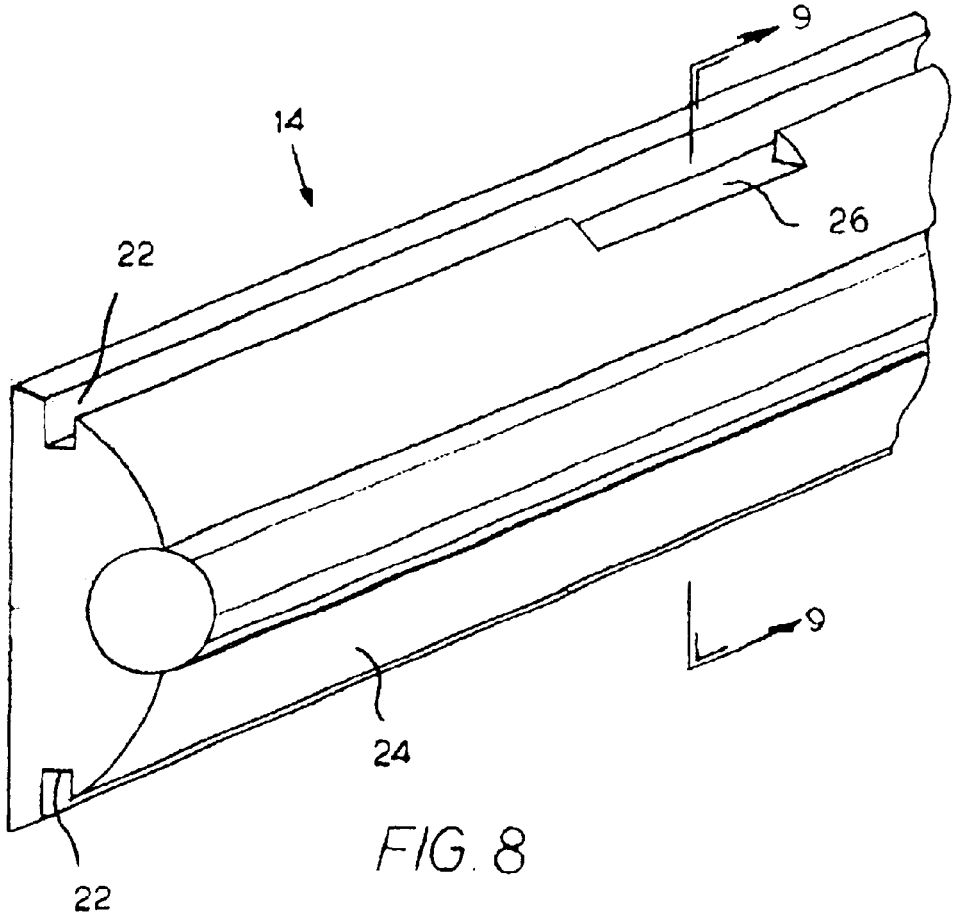
FIG. 8 is a perspective view of the rub rail of FIG. 5.
Figure 9:
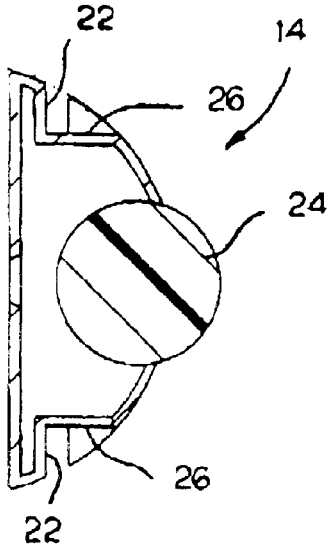
FIG. 9 is a view along line 9—9 of FIG. 8, showing the recess which permits the track follower to be inserted onto the rub rail.

FIGS. 8 and 9 show recesses 26, which extend from the outer surface of the track 14 to the grooves 22, but which are discontinuous in that they do not continue for the full length of the track as do the grooves 22. These recesses 26 have been formed by cutting away a portion of the track 14. The track follower 16 can be pushed into the recesses 26 to align the projecting legs 28 on the track follower 16 with the grooves 22, and then the track follower 16 can be slid along the track 14, with the legs 28 received in their respective grooves 22. Alternatively, the anchoring track follower 16 may be installed from the end of the track 14, in which case the recesses 26 are not required. While this embodiment provides grooves 22 in the track and projections 28 on the track follower 16 that are received in the grooves, the situation readily could be reversed, with the projections being located on the track and the grooves being located on the track follower. In fact, the cushion 24 on the track 14 is a projection that is received in a recess or groove of the track follower 16, although that single projection and groove do not serve to restrain the track follower to only longitudinal movement along the track. Also, while this mechanism provides for the follower 16 to slide along the track 14, many track/follower mechanisms are know which use rollers or other devices to facilitate the travel of a follower along a track while restricting movement of the follower to longitudinal movement along the track, and those mechanisms could alternatively be used here.

Figure 10:
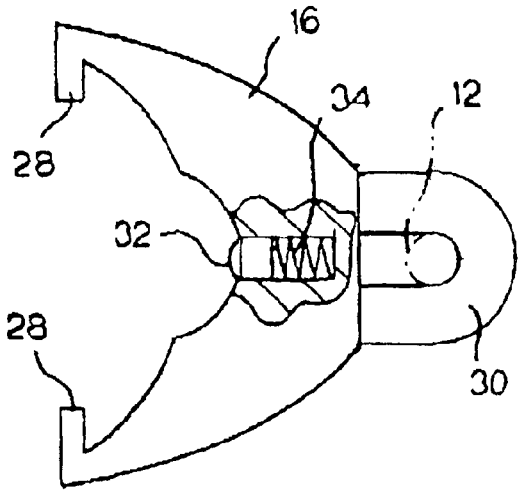
FIG. 10 is an end view of the track follower of FIG. 1.
Figure 13:
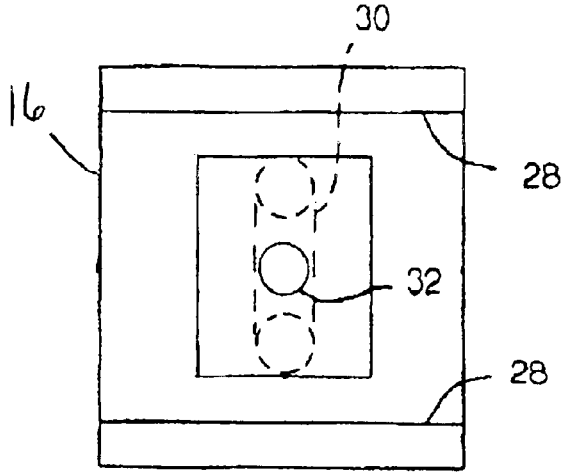
FIG. 13 is a view of the track follower of FIG. 1 taken from the inside or track side.

FIGS. 10 and 13 show the track follower 16, which has upper and lower projecting legs 28, which are received in the upper and lower grooves 22 of the track 14, so that the track follower 16 is retained on the track 14 and can slide longitudinally along the track 14. The track follower 16 also has an outwardly-projecting loop 30, which receives the rope 12, and a rounded inwardly-movable projection 32, which is biased inwardly by the spring 34. This inward projection 32 is used to releasably secure the track follower 16 to the stop 18, as will be described below.

Figure 11:
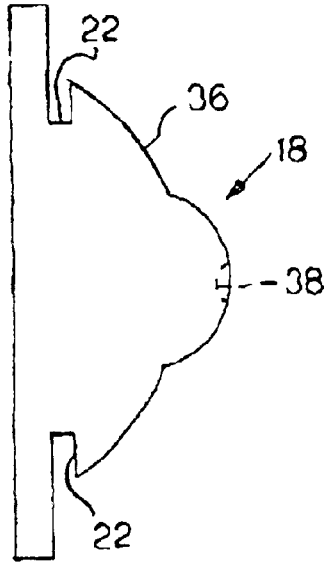
FIG. 11 is a side view of the stop which secures the track follower of FIG. 10 at the bow of the boat.
Figure 12:
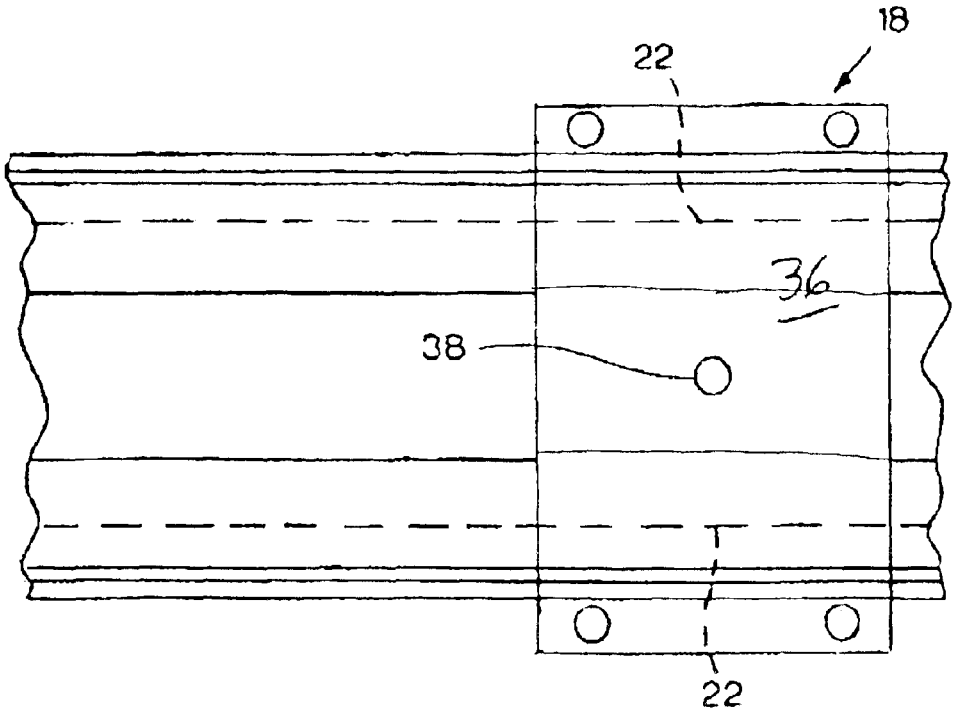
FIG. 12 is a front view of the stop of FIG. 11 mounted at the bow of the boat, in alignment with the rub rail of FIG. 5.

The stop 18, which is shown in FIGS. 11 and 12, is mounted to the hull of the boat 10 at the bow, adjacent to and in alignment with the track 14. The stop 18 has an outer surface 36 that conforms to the shape of the track 14 and complements the shape of the inner surface of the track follower 16. This outer surface 36 includes upper and lower grooves 22 that receive the upper and lower legs 28 of the track follower 16. The outer surface 36 of the securing mechanism 18 also defines a recess 38, which receives the inwardly-movable projection 32 to releasably secure the track follower 16 to the stop 18.

As the anchor 11 keeps the rope 12 tight, and as the boat 10 moves rearwardly relative to the anchor 11, the track follower 16 travels forward along the track 14 until it reaches the stop 18. When the spring-loaded projection 32 reaches the recess 38, it enters the recess 38, thereby releasably securing the track follower 16 to the stop 18.

When it is time to pull up the anchor 11, the user goes to the side of the boat 10, where he originally dropped the anchor 11, and tugs on the slack portion 12A of the rope 12, between the tie-down 20 and the track follower 16, as seen in FIG. 3. Since the projection 32 has a rounded end, and the recess 38 is also rounded, tugging on the track follower 16 will cause the projection 32 to ride rearwardly along the rounded surface of the recess 38, which functions as a ramp, gradually pushing the projection 32 outwardly against the biasing spring, until the projection retracts enough to leave the recess 38. Then, the person can continue pulling on the rope 12A, bringing the track follower 16 around to the side of the boat, and bringing the rope 12 and the anchor 11 into the boat 10. The person may also remove the track follower 16 from the track 14 and put the track follower 16, still secured to the rope 12, into the boat 10 as well, if desired.

As an alternative, the stop could provide a positive latching mechanism, such as a spring-loaded pin with a flat end that is received in a receptacle without a ramped surface, and such a latching mechanism could be unlatched by the user pulling on a rope which retracts the pin against the spring, or by some other know means.

Figure 14:
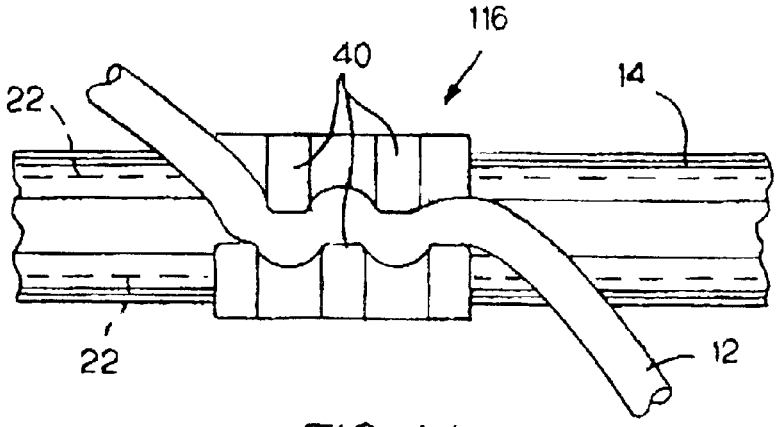
FIG. 14 shows an alternative type of track follower taken from the outside of the track follower.

FIG. 14 shows an alternative track follower 116, which has alternating fingers 40 on its outer surface for receiving and securing the rope 12 instead of the loop 30 of the first track follower 16.

Figure 15:
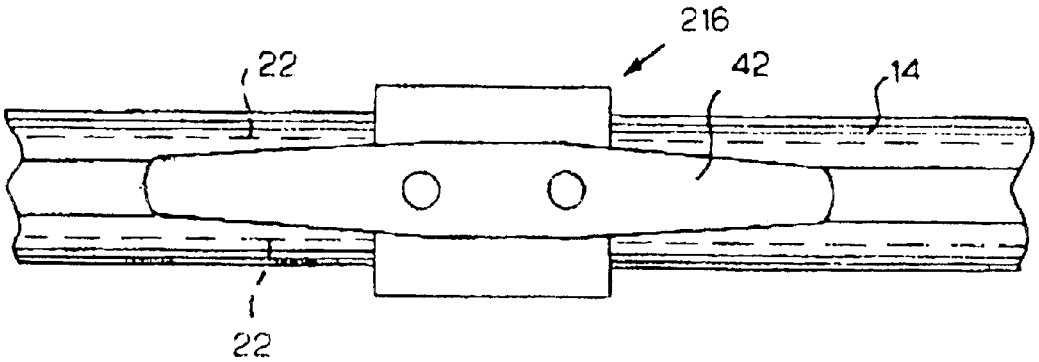
FIG. 15 is the same view as FIG. 14 but showing an alternate track follower.

FIG. 15 shows another alternative type of track follower 216, which uses a tie-down 42 instead of the loop 30.

Figure 16:
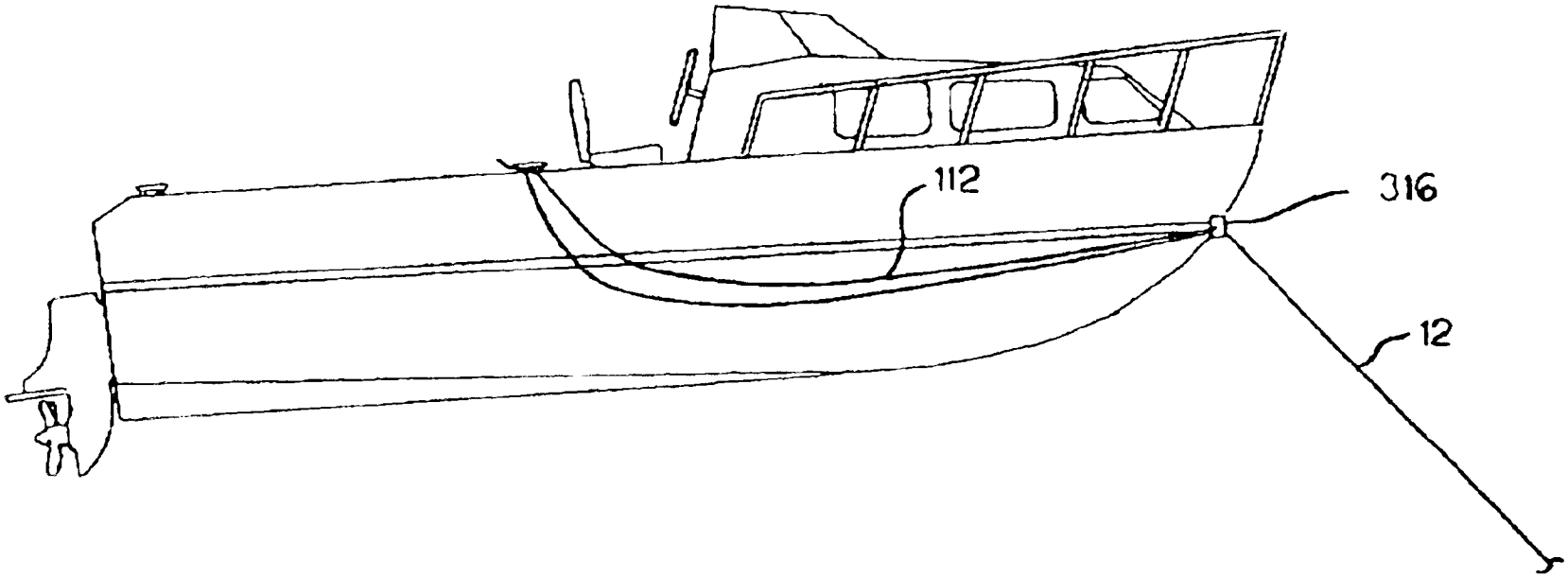
FIG. 16 is the same view as FIG. 3, but showing an alternate embodiment, in which a second rope is used to return the track follower to its starting position.
Figure 17:
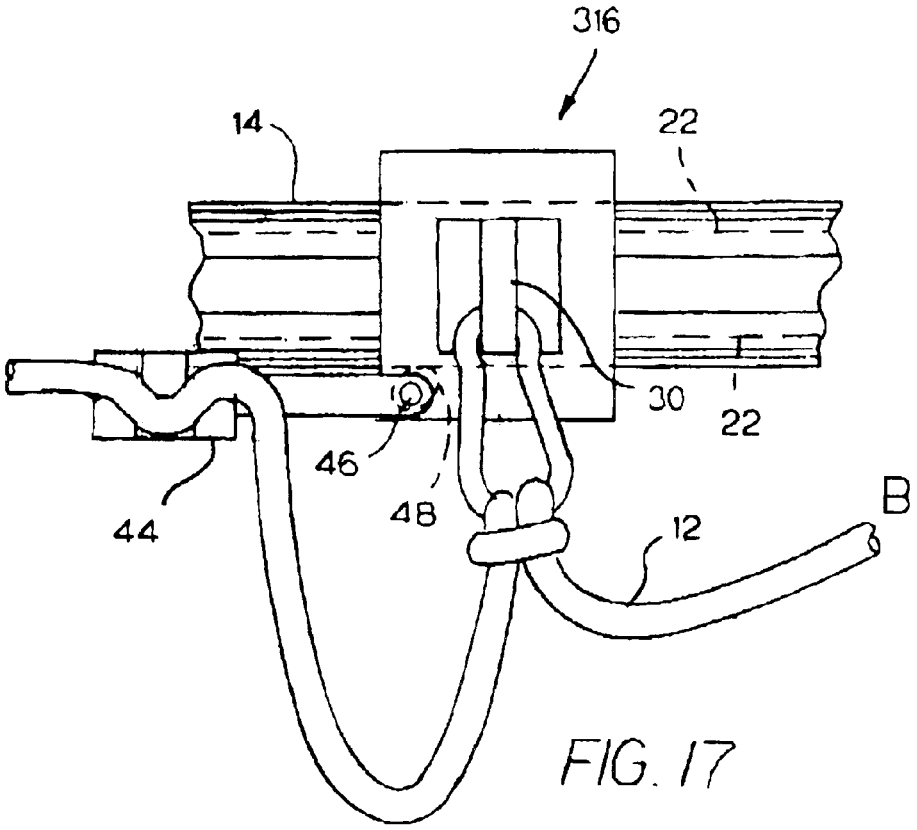
FIG. 17 is an outside view of the track follower of FIG. 16.
Figure 18:
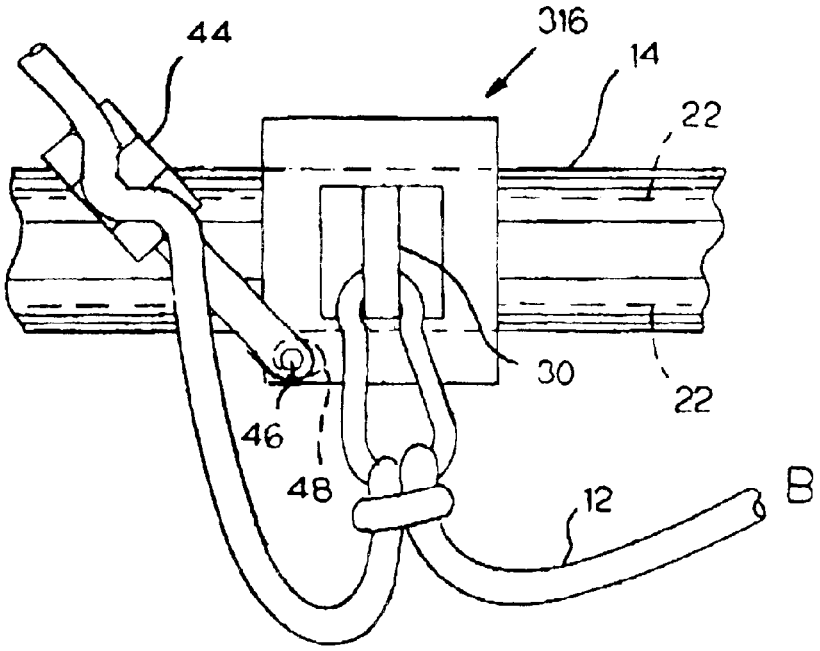
FIG. 18 is a schematic view of the track follower of FIG. 17, showing the track follower in a disengaged, or travel, position.

FIGS. 16–18 show another alternative embodiment of a track follower 316. In FIG. 16, a second rope 112 is used to release the track follower 316. In FIGS. 17 and 18, instead of using a second rope, the main rope 12 is secured to the track follower 316 at two different points. The first point 30 is the anchoring point 30, and the second point is at the free end of a pivot arm 44, which is mounted on the track follower 316.

In this embodiment, as shown in FIGS. 17 and 18, a cam 48 is mounted on the track side of the track follower 316 for rotation with the pivot arm 44 and pivots with the pivot arm 44 about the same axis 46 as the pivot arm 44. When the pivot arm 44 is in its lowered position (as shown in FIG. 17), the cam 48 wedges against the top of the lower slot 22, which prevents travel of the track follower 316 along the track 14. To release the track follower 316, the user tugs on the slack portion of the rope 12, which causes the pivot arm 44 to pivot or swing up from the lowered position shown in FIG. 17 to the raised position shown in FIG. 18. This rotates the cam 48, causing the cam 48 to release its grip against the track 14, allowing the track follower 316 to travel along the track 14. The cam 48 may be designed such that it only locks the track follower 316 against movement in one direction (typically in the direction toward the rear of the boat 10), while allowing the track follower 316 to travel in the other direction, toward the bow of the boat, even with the pivot arm 44 in the "locked" lower position shown in FIG. 17. In that case, the arm 44 may be biased toward the locked position under normal circumstances and need only be released when it is time to pull up the anchor.

Alternatively, the cam 48 may lock against a portion of a stop mounted at the bow of the boat (instead of locking against the track 14). In this situation, the arm 44 would be biased toward the locking position, so the track follower 316 locks in position when it reaches the stop. Then the pivot arm 44 may be pulled to release the track follower 316 from its stop in order to pull the track follower 316 back to the side of the boat.

Figure 19:
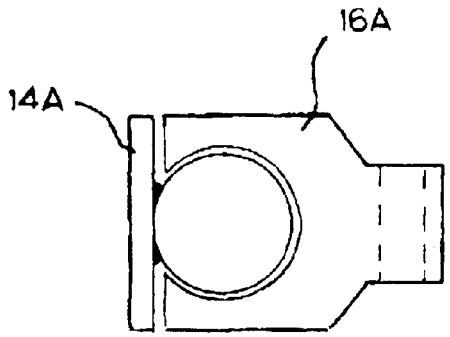
FIG. 19 is a view of an alternate track follower and track for use with the present invention.
Figure 20:
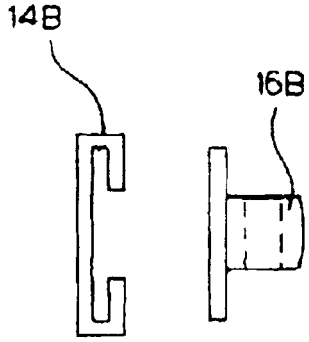
FIG. 20 is a view of another alternate track follower and track for use with the present invention.
Figure 21:
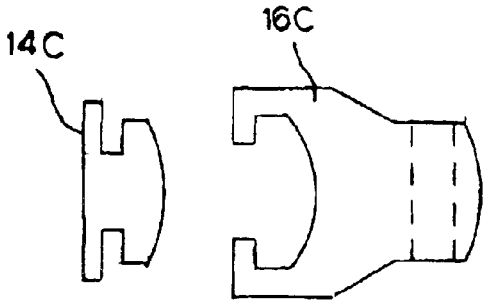
FIG. 21 is a view of still another alternate track follower and track for use with the present invention.
Figure 22:
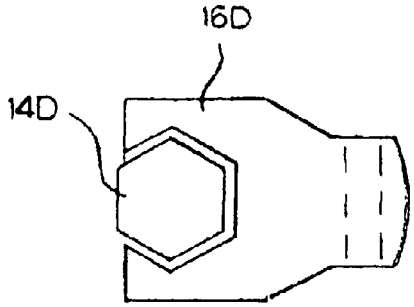
FIG. 22 is a view of still another alternate track follower and track for use with the present invention.

FIGS. 19–22 show various shapes of mating tracks 14A–D and track followers 16A–D, which permit the track follower 16 to slide along the track 14 while being restrained to longitudinal movement along the track 14. FIG. 19 provides a recess or groove on the track follower, which receives an elongated projection on the track. The recess wraps around the top and bottom edges of the projection, thereby restricting movement of the follower to longitudinal movement along the track. FIG. 20 provides upper and lower grooves on the track 14B and upper and lower projections on the follower 16B, which are received in the grooves. FIG. 21 is similar to the first embodiment, with upper and lower legs on the track follower 16C received in grooves on the track 14C. The design of FIG. 22 provides projections on the track 14D and grooves on the track follower 16D. In all these examples, the track and track follower cooperate to restrict motion of the track follower to longitudinal motion along the track. Of course, wheels or other devices to reduce friction between the track follower and the track 14 may be added as well, if desired.

Figure 23:
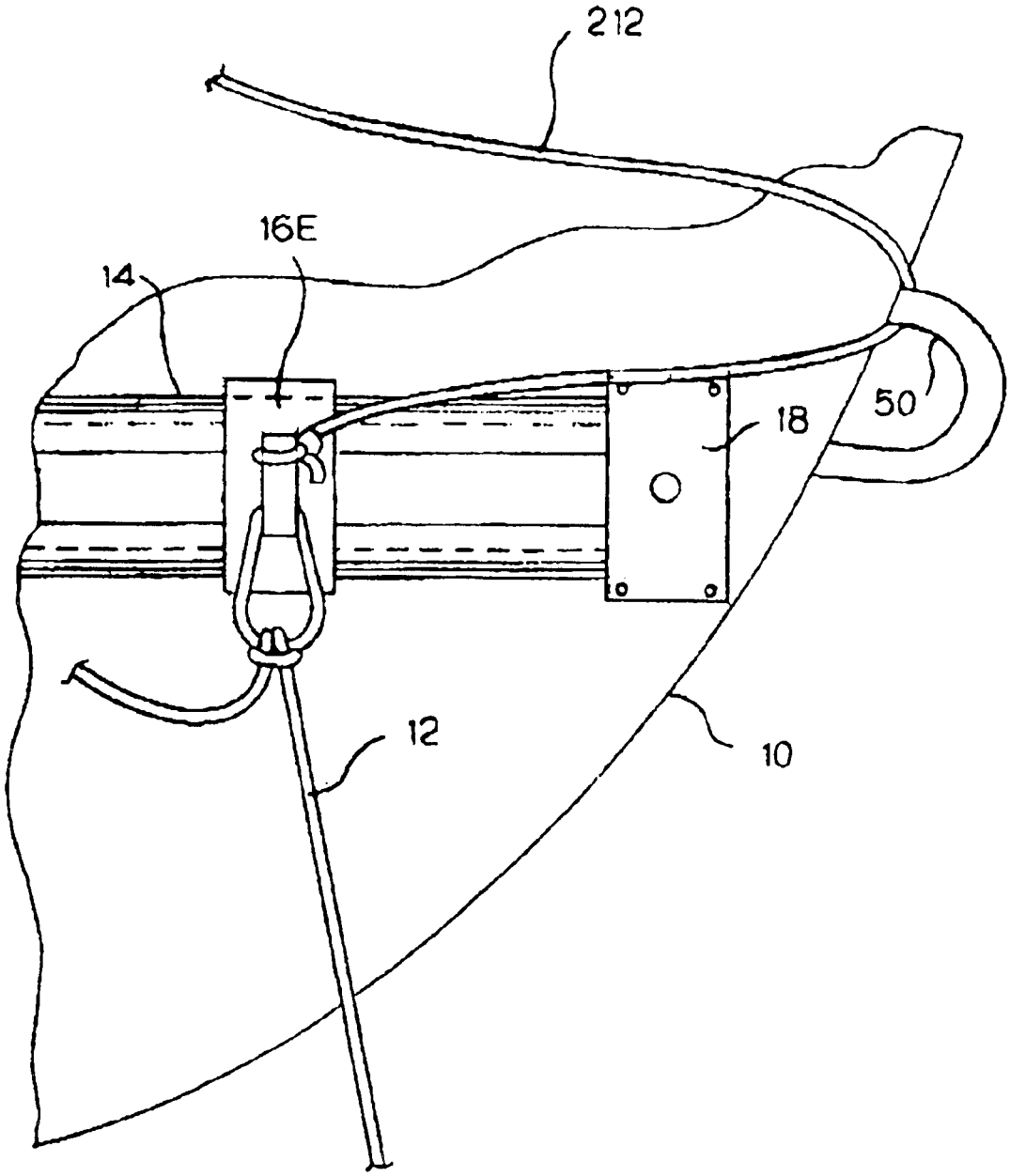
FIG. 23 shows an arrangement in which the track follower is pulled to the bow of the boat with a separate rope.

FIG. 23 shows an arrangement in which a separate rope 212 is used to pull the anchoring track follower 16E to the bow of the boat 10. At the bow of the boat 10 is a loop 50, through which the rope 212 passes, so the person pulling the separate rope 212 may be inside the boat, far from the bow, but the loop 50 causes the rope 212 to pull the track follower toward the bow. The end of the rope 212 is secured to the track follower 16E, and the anchoring rope 12 also is secured to the track follower 16E, as in earlier embodiments. This arrangement could be used if it is desired to positively move the track follower to the bow of the boat, without having to rely on wind or currents.

While several different embodiments have been shown here, it will be obvious to those skilled in the art that many modifications may be made to the embodiments described above without departing from the scope of the present invention.

What is claimed is:

1. A boat anchor deployment mechanism, comprising:

a boat;

a track secured to the boat and extending longitudinally along the boat;

a track follower mounted on said track for longitudinal travel along said track;

an anchor; and a rope securing said anchor to said track follower, wherein said track defines at least one discontinuous recess for mounting said track follower on said track.

2. A boat anchor deployment mechanism, comprising:

a boat defining a front, rear, and at least one side;

a track secured to the boat and extending longitudinally along the side of the boat and extending to the front;

a track follower mounted on said track for longitudinal travel along said track;

an anchor; and a rope securing said anchor to said track follower, wherein said track defines at least one longitudinally extending projection and said track follower defines a groove that receives said projection.

3. A boat anchor deployment mechanism, comprising:

a boat defining a front, rear, and at least one side;

a track secured to the boat and extending longitudinally along the side of the boat and extending to the front;

a track follower mounted on said track for longitudinal travel along said track;

an anchor;

a rope securing said anchor to said track follower, a stop mounted at the front of said boat for stopping the travel of said track follower; and means for automatically stopping said track follower when it reaches said stop without requiring external control.

4. A boat anchor deployment mechanism as recited in claim 3, and further comprising a locking means which releasably secures said track follower to said stop.

5. A boat anchor deployment mechanism as recited in claim 4, wherein said locking means includes a spring-biased projection on one of said track follower and said stop and wherein the other of said track follower and said stop defines a receptacle which receives said spring-biased projection.

6. A boat anchor deployment mechanism, comprising:

a boat defining a front, rear, and at least one side;

a track secured to the boat and extending longitudinally along the side of the boat to the front;

a track follower mounted on said track for longitudinal travel along said track;

an anchor;

a rope securing said anchor to said track follower, and further comprising an elongated, outwardly-projecting cushion on said track, permitting said track to serve as a rub rail.

7. An anchor-mounting arrangement for mounting an anchor on a boat hull having left and right sides, a front and a rear, comprising:

a track mounted on the boat hull and extending longitudinally from at least one side to the front of the boat;

a track follower mounted on said track for longitudinal movement along said track;

means for securing an anchor rope to said track follower;

a releasable locking means for locking the position of said track follower; and a stop mounted on the front of said hull, said stop including a portion of said releasable locking means;

wherein said releasable locking means includes a recess on said stop and a movable projection on said track follower which is received in said recess; and wherein said movable projection is spring-biased.

8. An anchor-mounting arrangement for mounting an anchor on a boat hull having left and right sides, a front and a rear, comprising:

a track mounted on the boat hull and extending longitudinally from at least one side to the front of the boat;

a track follower mounted on said track for longitudinal movement along said track;

means for securing an anchor rope to said track follower; and a releasable locking means for locking the position of said track follower;

wherein said releasable locking means includes a movable arm on said track follower and a cam which moves with said movable arm.

9. An anchor-mounting arrangement for mounting an anchor on a boat as recited in claim 8, wherein said movable arm and said cam are pivotable about the same axis.

10. A passive boat-orienting system, comprising:

a track mounted on the boat hull and extending longitudinally from at least one side to the front of the boat;

a track follower mounted on said track for longitudinal movement along said track;

an anchor;

a rope securing said anchor to said track follower; and means permitting said anchor rope to drive said track follower along said track;

wherein said track follower is the only track follower that is mounted on said track and secured to an anchor.

* * * * *